US008382024B2

(12) United States Patent
Fries et al.

(10) Patent No.: US 8,382,024 B2
(45) Date of Patent: Feb. 26, 2013

(54) DEVICE FOR CONTROLLING THE DRIVE OF A REEL

(75) Inventors: Stefan Fries, Reutlingen (DE); Werner Steinhilber, Moessingen (DE); Helmut Lengerer, Sonnenbuehl (DE)

(73) Assignee: Wafios Aktiengesellschaft, Reutlingen (DE)

( * ) Notice: Subject to any disclaimer, the term of this patent is extended or adjusted under 35 U.S.C. 154(b) by 374 days.

(21) Appl. No.: 12/902,926

(22) Filed: Oct. 12, 2010

(65) Prior Publication Data

US 2011/0226885 A1 Sep. 22, 2011

(30) Foreign Application Priority Data

Mar. 22, 2010 (DE) ..... 10 2010 012 263

(51) Int. Cl.

| | |
|---|---|
| ***B21C 47/16*** | (2006.01) |
| ***B21C 49/00*** | (2006.01) |
| ***B21F 23/00*** | (2006.01) |
| ***B65H 51/30*** | (2006.01) |
| ***B65H 59/38*** | (2006.01) |

(52) U.S. Cl. ..... 242/420; 242/564.1; 242/564.4; 226/118.2; 226/122; 57/264

(58) Field of Classification Search ..... 242/420, 242/420.5, 421, 564, 564.1, 564.3, 564.4, 242/564.5; 226/32, 43, 118.2, 118.3, 122; 57/78, 90, 91, 264; 72/8.6, 11.4, 12.3, 205, 72/135, 146, 148, 183; 140/93 R, 93.2
See application file for complete search history.

(56) References Cited

U.S. PATENT DOCUMENTS

| | | | |
|---|---|---|---|
| 3,137,452 | A | 6/1964 | Winders |
| 4,241,884 | A | 12/1980 | Lynch |
| 4,899,945 | A | 2/1990 | Jones |

FOREIGN PATENT DOCUMENTS

| | | | |
|---|---|---|---|
| DE | 30 10 508 | C2 | 9/1980 |
| DE | 32 35 217 | A1 | 3/1984 |
| DE | 34 22 499 | A1 | 12/1985 |

*Primary Examiner* — William E Dondero

(74) *Attorney, Agent, or Firm* — Patterson Thuente Christensen Pedersen, P.A.

(57) ABSTRACT

With a device for controlling the drive of a reel, with a wire supply in the form of a coil of said wire supply, from which the wire, through interposition of a tensioning device, which is spring-pretensioned in one deflection direction and effective up to a maximum deflection, for approximated stabilization of the wire tension of a feed installation of the wire infeed of a downstream positioned wire processing machine, the velocity curve of the feed rate of the wire infeed in accordance with a preset velocity-time profile is controlled by a control unit of the wire processing machine, and whereby the curve of the rotation speed of the reel in accordance with a preset rotation speed-time profile is controlled by the drive control of the reel, whereby the drive control of the reel sets the rotation speed-time profile of the reel, with regard to the velocity-time profile of the feed rate, forward by a preset time interval.

19 Claims, 3 Drawing Sheets

DEVICE FOR CONTROLLING THE DRIVE OF A REEL

This application claims priority to German Patent Application No. 10 2010 012 263.7 filed on Mar. 22, 2010, which is incorporated herein by reference in its entirety.

FIELD OF THE INVENTION

The present invention relates to a device for providing wire and controlling the drive of a reel with a wire supply in which the wire is spring-pretensioned for approximated stabilization of the wire tension of a feed installation of the wire infeed of a downstream positioned wire processing machine.

BACKGROUND OF THE INVENTION

Processing machines for processing coil material, such as spring machines, bending machines, nailing machines, leveling machines, etc. operate, as a rule, together with reels, which hold a supply of coil material, such as wire. Starting with said coil, e.g., the wire is fed to the processing machine, which is downstream of the reel. The reel is usually driven at a constant rotation speed, whereby the rotation speed of the reel determines how much wire is unwound from the coil and fed to the downstream processing machine. Thereby, the reel rotation speed can be adjusted via a tensioning device, such as a deflection arm, which is attached to the reel, spring-pretensioned in a deflection direction, effective up to a maximum deflection, and adjusted to the decreasing diameter of the coil to be processed or, adjusted in case of greater or smaller than desired wire tension, whereby, e.g., in case of a radially outward moving deflection arm, the reel rotation speed is increased, or in case of an unchanged position of the deflection arm is set freely revolving, or in case of a radially inward swiveling of the deflection arm, an acceleration of the reel rotation speed is achieved (see DE 30 10 508 C2).

It has become evident that problems occur rarely with such processing machines with a sufficiently constant infeed speed or with a relatively evenly intermittent, moderately fluctuating at its temporal mean, infeed speed profile of the machine infeed (such as in tension spring and compression spring machines, or special processes, ring winding machines and the like), since the reel control is sufficiently capable of following the requirements of the processing machine via dancer, deflection arm and/or workpiece storage (e.g., multiple redirections).

However, this is no longer the case with processing machines with a regularly intermittent but greatly fluctuating infeed speed (e.g., tension spring and compression spring machines with special processes) and with machines with irregularly intermittent infeed speed profile (such as leg spring machines, wire-bending and pipe-bending machines), which frequently experience problems because the reel control via dancer, deflection arm and/or storage cannot follow the requirements of the processing machine, i.e., the parts-specific infeed speed profile.

For example, the control utilized in the arrangement in DE 30 10 508 C2 is not capable of achieving a sufficiently quick reaction of the reel with high dynamic processing machines.

In the arrangement in DE 34 22 499 A1, a transducer attached to the infeed rollers of the downstream-positioned processing machine is used for controlling the speed of the reel. However, this has the disadvantage that the reel rotation is always a reaction to the infeed movement, which, once again, does not allow for a sufficiently quick and satisfactory adjustment of the movement profile of the reel rotation to the machine infeed.

In the arrangement described in DE 32 35 217 A1, two deflection arms are provided for compensation of larger differences in the infeed speed. However, this requires a huge mechanical effort and great retooling effort in order to adjust the reel to new parts and/or movement profiles, whereby in this known arrangement, a control process for the reel drive is only triggered if the amount of wire demanded by the infeed of the processing machine changes. As a result, the reel rotation speed is once again a reaction to the infeed speed.

With the known arrangements of a control for the reel drive of a wire processing machine, the requirements can be such that the reel can rotate as continuously and evenly as possible without simultaneously limiting the high dynamic of the processing machine, which cannot be sufficiently achieved with the redirections, dancers, storage (deflection arms) and the like utilized with known reels, resulting in an unsteady motion of the reel, kinks in the wire or greatly fluctuating tensile loading in the wire. However, these effects are quite unfavorable for the accuracy and reproducibility of the actual processing tasks on the wire and/or pipe.

Therefore, according to the invention, a device shall be suggested for the control of the drive of a reel whereby the aforementioned disadvantages shall be largely avoided.

SUMMARY OF THE INVENTION

According to an embodiment of the invention, this is achieved with a device for controlling the drive of a reel, with a wire supply in the form of a coil holding said wire supply from which the wire, through interposition of a tensioning device, which is spring-pretensioned in one deflection direction and effective up to a maximum deflection for approximated stabilization of the wire tension of a feed installation of the wire infeed of a downstream positioned wire processing machine, whereby the velocity curve of the feed rate of the wire infeed in accordance with a preset velocity-time profile is controlled by a control unit of the wire processing machine, and whereby the rotation speed curve of the reel in accordance with a preset rotation speed-time profile is controlled by the drive control of the reel, whereby the drive control of the reel starts the rotation speed-time profile of the reel, with regard to the velocity-time profile of the feed rate, set forward by a preset time interval.

Therefore, with an embodiment of the invention the invention, the reel rotation is no longer controlled, as in the prior art, as a reaction to the conditions at the feed device of the wire infeed of the downstream-positioned wire processing machine, which leads to unwanted pressure peaks particularly during the startup phase of reel and wire processing machine, until the control of the reel is adjusted to the wire demand of the feed device of the wire infeed. By contrast, the invention, aside from the preset velocity-time profile for the control of the wire processing machine, which is adjusted to its respective machining operation to be performed, also operates with a preset rotation speed-time profile for the drive control of the reel, which is fittingly adjusted to the velocity-time profile of the wire infeed and thereby takes into account and utilizes, the sequential infeed lengths of the part to be manufactured as well as the sequential accelerations of the processing machine for the control of the reel rotation speed.

However, in this solution, the rotation speed-time profile for the reel control is preset from the start, so that no control takes place as a reaction to a prior behavior of the infeed movement of the wire infeed.

Due to the fact that the preset rotation speed-time profile of the reel in comparison to the velocity-time profile of the feed velocity of the wire infeed is started set forward by a preset time interval by the control of the reel drive, i.e., the reel drive already sets in at a point in time when the control unit of the processing machine has not yet started the velocity-time profile of the feed velocity of the infeed but which takes place rather time-delayed only after startup of the reel drive, it can basically be achieved that the reel will already have released some wire before the startup of the infeed rollers of the wire infeed of the processing machine, and that said wire is now already available at the entrance of the infeed rollers of the infeed at the time of their start-up and, therefore, does not have to be pulled by the wire infeed rollers from the downstream-positioned coil under build-up of tension peaks. Due to the fact that the preset rotation speed-time profile for the reel drive is adjusted to the preset velocity-time profile of the drive of the infeed rollers at the wire infeed of the processing machine, it is possible to invariably take into account any changes in the curve of the wire infeed speed at the wire infeed earlier through an appropriate change in the rotation speed-time profile of the reel. For example, even with high dynamic processing machines, through the appropriate choice of the time advance of the drive of the reel, the quick speed changes on the reel side of the infeed rollers of the wire infeed can be compensated, and the larger amounts of wire required with quick accelerations or decelerations of the infeed speed of the infeed rollers can be built up in due time or their deceleration taken into account in due time. This is also important because the great weight of the wire coils only allows for significantly more limited accelerations and/or decelerations of the rotation speed of the reel (and therefore the wire to be released) than is possible on the side of the infeed rollers of the wire infeed.

In an embodiment of the invention, a particularly steady reel motion, even with quick changes in the infeed behavior of the wire infeed, as well as no unnecessary accelerations and a consistent processing quality are achieved. Furthermore, a relatively constant tensile loading in the wire can be maintained and overall greater processing speeds are possible than with the known arrangement. In addition, a completely trouble-free startup and turn off of the wire processing machine is possible. Overall, greater operational safety will be achieved and different parts can be manufactured in successive sequence without reel changeover.

The now barely fluctuating tensile loadings in the wire, achieved with the invention, have a favorable effect on the accuracy and reproducibility of the actual processing tasks on wire and/or pipe.

In an embodiment of the invention, the rotation speed-time profile of the reel is rendered from the velocity-time profile of the feed rate by determining a respective rotation speed of the reel for every feed rate of the velocity-time profile, whereby the wire dispensing speed of the reel equals the feed rate of the wire infeed. With such a rotation speed-time profile of the reel drive derived from the velocity-time profile of the feed rate of the wire infeed, it is ensured that within the respective profile, the wire dispensing length at the reel corresponds with the wire infeed amount at the wire infeed of the processing machine, so that after a one-time run-through of the profile on the side of the reel, the amount of wire dispensed is equal to the amount fed at the wire processing machine on the side of the infeed.

Even with a simultaneous run of both profiles with a temporal offset between them, only slightly fluctuating tensile loading is created. And if the start of the reel drive effected by the reel control takes place earlier by a suitable time interval than the startup of the feed device of the wire infeed of the wire processing machine, a further uniformity and improvement in the overall process can be achieved.

In a further embodiment of the invention, the preset time interval, by which the rotation speed-time profile of the reel is started in advance of the velocity-time profile of the feed rate is determined in such a way that the wire dispensing length, supplied along its curve in accordance with the rotation speed-time profile of the reel is smaller than the wire length which the tensioning device can compensate at maximum deflection, so that even at the beginning phase, including the startup of the feed device of the wire infeed, the possibility for compensation of potential tensile fluctuations in the wire is ensured.

In a further embodiment of the invention, preset values for a maximum acceleration and maximum deceleration of the reel are taken into account for determining the rotation speed-time profile, whereby in the case of acceleration and deceleration processes in the velocity-time profile of the wire infeed, which each would lead to greater than the preset values for maximum acceleration and maximum deceleration for the rotation speed-time profile of the reel, the latter are replaced through application of the preset values for maximum acceleration and deceleration and temporally extended in such a way that the wire infeed length of the wire infeed, corresponding with the acceleration or deceleration phase, corresponds with the released wire dispensing length of the reel.

Thereby, the beginning of an acceleration phase lengthened in such a way and the end of a deceleration phase lengthened in such a way remains unchanged when compared to the beginning and/or end of the corresponding acceleration or deceleration phases of the velocity-time profile of the feed rate. With these measures, the maximum deceleration and acceleration values for the reel can be maintained during the determination of the rotation speed-time profile for the reel, even if acceleration or deceleration phases at the velocity-time profile of the wire infeed would lead to too great an acceleration and/or deceleration value in the rotation speed-time profile of the reel, and thereto the respective acceleration and/or deceleration phases in the rotation speed-time profile of the reel are expanded in such a way that the wire lengths dispensed by the reel during such a phase correspond to the wire lengths received at the wire infeed during said phases.

In another embodiment of the invention, the determination of rotation speed-time profile of the reel from the velocity-time profile of the feed rate is effected by the control unit of the wire processing machine and is transmitted from there to the drive control of the reel. In this way, an automatic generation of the respective rotation speed-time profile of the reel directly through the control unit of the wire processing machine is possible.

A further embodiment of the invention also relates to the depiction of the unsteady speed changes present in the rotation speed-time profile for the reel present in the velocity-time profile of the feed rate as steady profile transition, for example, roundedly shaped transitions in the graph of the rotation speed-time profile. This allows for operation with particularly small tension fluctuations in the wire.

In a further embodiment of the invention, the rotation speed-time profile of the reel, derived each time from the velocity-time profile of the feed rate for the duration of the processing during ongoing manufacturing of the same workpieces on the wire processing machine, is replaced by a periodically changing rotation speed-time profile, which, within the time interval of the duration of the processing of a workpiece, supplies the same wire dispensing length as the initially derived rotation speed-time profile and the graph of which thereby runs through a complete vibration period or an integer multiple of such a period.

Since the rotation speed-time profile of the reel in this embodiment consistently shows evenly occurring vibrations during the ongoing manufacturing of the same workpieces, a particularly simple control of such a reel drive and, overall, a particularly high processing speed can hereby be achieved.

In order to take into account the decrease of the coil diameter on the reel during the manufacture of a great number of the same workpieces, a continuous increase of the reel rotation speed, compensating for the decrease of the coil diameter, with otherwise identical rotation speed-time profile curve is performed through the control of the reel drive in this further preferred embodiment of the invention.

BRIEF DESCRIPTION OF THE FIGURES

In the following, the invention is further explained in principle by way of example with the help of the drawings.

DETAILED DESCRIPTION

Figure 1:
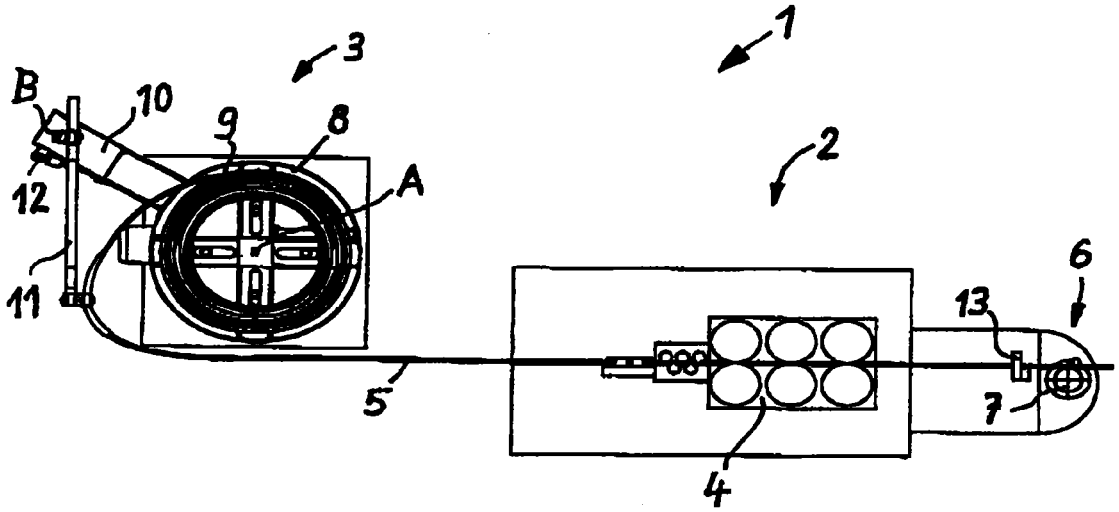
FIG. 1 shows a top view of a processing installation with a reel and a wire bending machine.

FIG. 1 shows a top view of a wire bending installation 1 which consists of a processing machine 2 (here: a wire bending machine) and a reel 3. The processing machine 2 contains a feed or infeed device 4, e.g., a roller infeed, which pulls the wire 5 from the reel 3 and feeds it to a processing area 6, in the drawing a bending head 7, of the processing machine 2.

The reel 3 is equipped with a drive (not shown), which includes a coil holder 8 and which rotates the reel as well as the overlying wire coil 9 around a rotation axis A in order for the coil material to roll off.

Furthermore, reel 3 exhibits an attached cantilever 10, which holds a swivel arm 11, which in turn is swiveling around the axis B and which is controlled by a control unit 12 in such a way that as constant as possible a tensile force exists on the wire 5 between the infeed 4 and the reel 3. Via the size and the direction of the deflection of the deflection arm 11, the rotation speed of the reel 3 can be changed. The objective thereby is to achieve a center position of the deflection arm 11, which is as continuous as possible.

The wire processing in such a bending installation 1 is executed as follows:

The reel 3 is driven with a determined rotation speed suitable for the processing task. The infeed 4 of the processing machine 2 (bending machine) is activated by a control of the processing machine 2 and pushes the wire 5 to the processing area 6 of the processing machine 2 until a first bending point is reached. Then the infeed 4 is stopped and through actuation of the bending tool (bending head 7) a first bend in the wire 5 is produced.

After the bending head 7 is reset, the infeed 4 is once again activated and a further piece of wire is pulled in. The infeed length depends on which distance is needed between the first and the second bend of the workpiece to be processed. The infeed 4 is then stopped again, after which a possible twisting of the wire 5 can take place, whereby the infeed 4 is rotated around the wire axis. Afterwards, a further bend of the workpiece to be processed is produced.

In accordance with this process, the time-dependent movement profile (acceleration, deceleration, stop, constant velocity, etc.) of the feed rate of the infeed 4 is compiled. Depending on the processing task, said movement profile is individual and can vary greatly with different processing machines (such as bending, leg spring, compression spring, leveling, nailing, pipe bending machines, etc.) The infeed 4 must satisfy varying demands on different machines. For the most part, its task is to pull the wire 5 from the coil 9 in order to position the individual wire processing points in the processing area 6 in sequence. However, a forming of the wire 5 through the feed force of the infeed 4 can also be achieved, e.g., during the manufacture of helical coils, the wire 5 is continuously pushed by infeed 4 against a coiling plate, coiling roller or other tools and thereby formed. In addition, a rearward movement of the wire 5 is also possible in order to perform special operations. This occurs, e.g., when the workpiece is to be cut off directly next to a bend: The last bend is produced and then the wire 5 is pulled back to the extent that a sheering (cut 13) directly next to the bend can be effected.

From this description it has become apparent that usually an irregular wire feed, sometimes even a wire pull-back, takes place. This irregularity, however, makes it very difficult and partly impossible to set the reel 3 at a sensible rotation speed. Thereby, a dynamic acceleration of the reel 3 with the wire coil 9, weighing over 1 ton, synchronous to the processing machine is frequently impossible.

Figure 2:
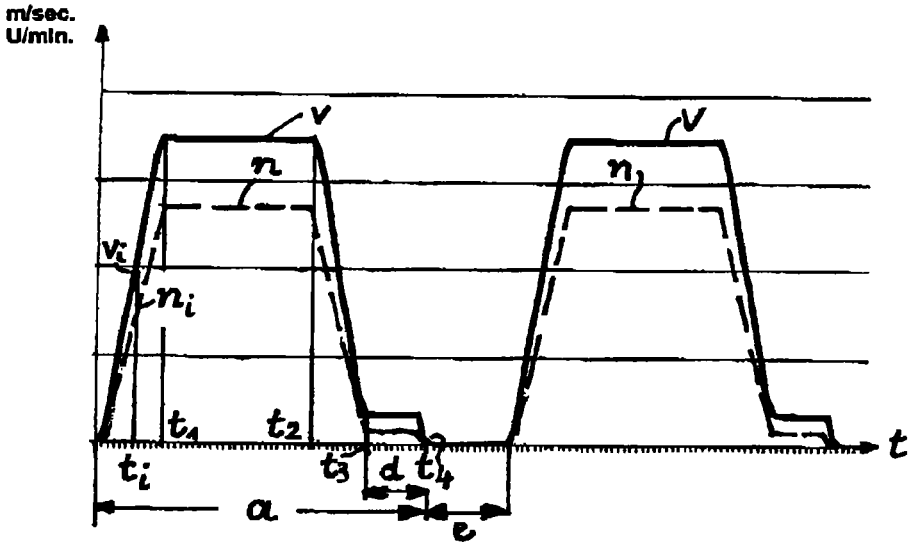
FIG. 2 shows a graph of a velocity-time profile for the wire feed and the derived rotation speed-time profile for the reel drive.

FIG. 2 shows in solid lines the diagram of the velocity-time profile of the infeed 4 and (as dashed line) the diagram of the rotation speed-time profile of the reel 3 for the manufacture of a bent part as applies to a compression spring machine. The depiction shows a cycle for the manufacture of two springs.

Thereby, above the time t, the infeed speed v of the feed device 4 is shown as the solid line and the rotation speed n of the reel 3 as the dashed line. In the areas a, the feed device and/or infeed 4 are active. At first the infeed 4 is accelerated to the moment $t_1$, holds its speed until the moment $t_2$ and is then decelerated until the moment $t_3$, whereby the wire 5 hereby is only transported forward. At the end of the first cycle, an area d with slower feed rate is provided, within which, e.g., a measuring of the workpiece or the move toward an endstop takes place. At the moment $t_4$, the first cycle is completed. Within the following area e, the wire 5 stands still and the cut is effected.

Here the next production cycle follows. In this example, the forming of the wire 5 takes place while the wire feed 4 is active. When the wire 5 and therefore the infeed 4 are inactive, no forming is effected.

FIG. 2 also shows, as dashed lines, the rotation speed-time profile of the reel 3, determined and derived from the velocity-time profile of the infeed 4 (solid lines). It was ascertained in such a way that at each of the moments $t_1$ the respective rotation speed $n_1$ of the reel 3 is determined from the respective value of the feed rate $v_1$ of the velocity-time profile of the infeed 4, whereby the wire dispensing speed of the reel 3 is equal to the feed rate $v_1$ of the wire infeed 4. The rotation speed-time profile of the reel 3, determined in accordance with said specifications, leads to the dashed profile shape in FIG. 2.

If the reel 3 is controlled in accordance with said rotation speed-time profile, it releases wire at each moment $t_1$ of this profile shape at a dispensing speed which exactly corresponds to speed $v_1$ with which the infeed 4 takes in wire at this moment. In other words, seen over the entire curve a of the time for the manufacture of a spring, the reel 3 releases exactly as much wire 5 as is pulled in at the infeed 4. As a result, it is possible to operate with a continuously very constant wire tension at the bending installation 1, whereby, due to the rotation speed-time profile for the reel 3, determined from the (already known) velocity-time profile of the infeed speed v of the bending machine 2 before the startup of the bending installation 1 for the manufacture of said springs, the control of the reel drive can be effected directly on the basis of the in advance determined rotation speed-time profile in correlation to the velocity-time profile of the infeed 4 without the control of the reel drive being readjusted as a reaction to a condition at the infeed 4, determined during operation of the installation.

Figure 3:
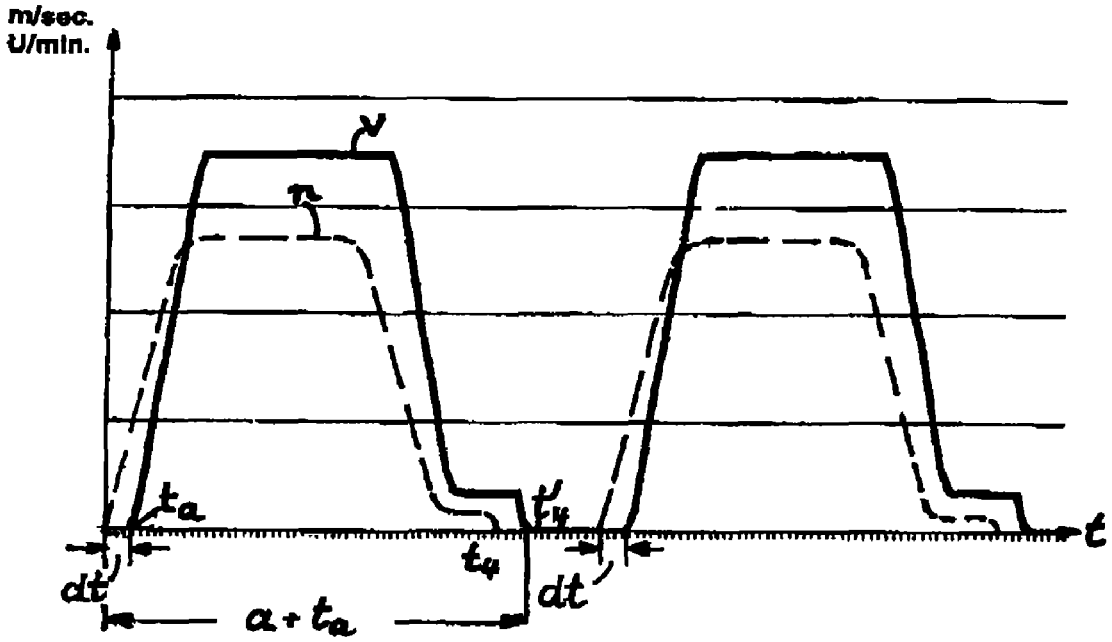
FIG. 3 shows the depiction of the graph from FIG. 2, whereby the rotation speed-time profile of the reel is set forward by a preset time interval with regard to the velocity-time profile of the feed rate, and whereby unsteady transitions are shown rounded.

While the depiction in FIG. 2 only serves as an explanation for the determination of the rotation speed-time profile of the reel 3 from the velocity-time profile of the infeed, FIG. 3 shows the profile shapes in FIG. 2 once again but in such a way that the (dashed) rotation speed-time profile of the reel 3 is set forward by a preset time interval dt with regard to the (solid line) velocity-time profile of the infeed 4.

This now represents the condition, whereby the drive control of the reel 3 starts said drive ahead of the moment $t_a$, at which the infeed 4 starts, by said preset time interval dt. This means that the reel 3 starts in this initial zone and already releases wire 5 up to the moment $t_a$ without the infeed 4 having started yet. This wire 5, already released by the reel 3, is intermittently compensated via the tensioning device in the form of the deflection arm 11, whereby the deflection arm 11 swivels in a further extended position and as a results compensates the released amount of wire in the area between the reel and the infeed 4 due to an increase of the wire loop effected by said deflection arm. Thereby, the time interval dt is chosen in such a way that the amount of wire released by the reel 3 can be compensated by the deflection arm 11 during said time interval, without the arm having to swivel to its maximum extended position. Due to the temporal advance dt of the rotation speed-time profile of the reel 3 with regard to the velocity-time profile of the infeed 4, the overall duration, over which the two overlapping profiles are overall extended, increases to $a+t_a$ since each of the profile shapes extend over a time period a.

As can be seen in FIG. 3, the reel drive starts before the drive of the infeed 4 but comes already to a standstill at the moment $t_4$ while the infeed 4 continues to operate until the moment $t_4'$. Due to this temporal shift by the time interval dt, an easing of the tension is achieved particularly in the area of the startup of the reel 3 and infeed 4 as well as in the area of the cessation of both drives because the drive of the reel 3 always changes its wire release speed by a preset time interval dt before the beginning of a change in speed at the infeed 4. Since, as a result, wire 5, prereleased by the reel 3, is available at the beginning of the startup of the infeed 4 as well as at the cessation of its supply for intake by the infeed 4, only small changes in tension occur in the wire at the beginning as well as the end of the delivery of the infeed 4. The depiction in FIG. 3 further clarifies that at the points in the rotation speed-time profile of the reel 3, which correspond with the unsteady speed changes in the velocity-time profile of the infeed 4, a steady transition is provided for each (which in the graph of the dashed curve in FIG. 3 is shown as curvature).

FIG. 4 once again shows the depiction from FIG. 2, but now, for the determination of the rotation speed-time profile of the reel 3, derived from the (solid line) velocity-time profile of the infeed 4, specifications for a maximum allowable acceleration and/or deceleration of the reel rotation speed n are taken into account for the event that the (dashed) curve for the reel 3, determined in accordance with FIG. 2, were to maintain too great, and for the drive control of the reel 3 unrealizable, an acceleration and/or deceleration during the acceleration or deceleration phases.

Figure 4:
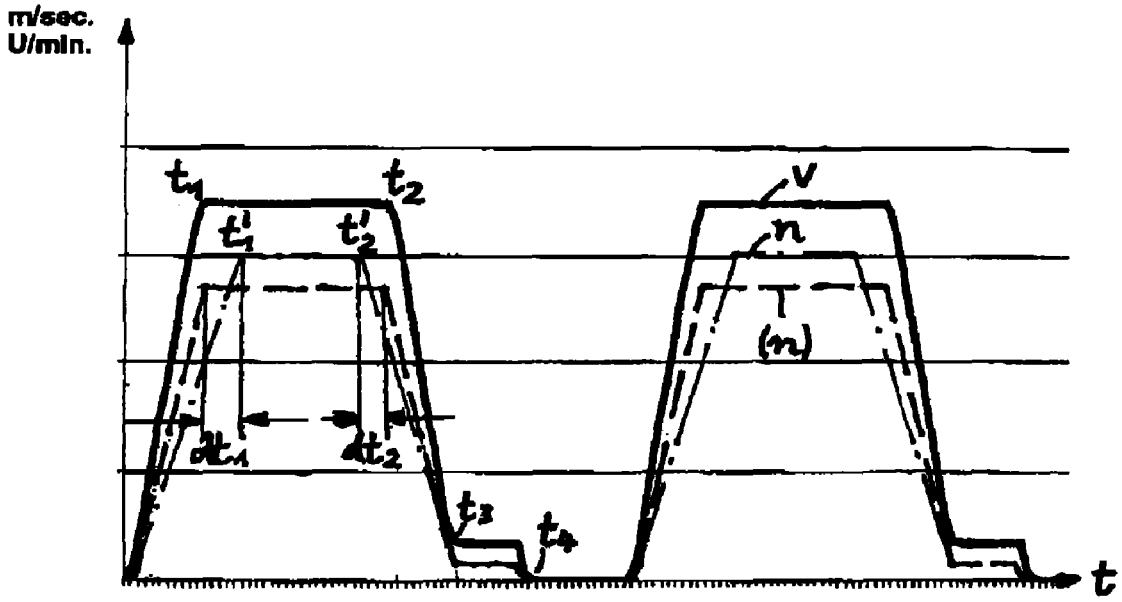
FIG. 4 shows a depiction in accordance with FIG. 2, whereby maximum values for the acceleration and for the deceleration of the reel are taken into account for the determination of the rotation speed-time profile of the reel.

For the depiction in FIG. 4, it is now assumed that from the acceleration between zero and the time $t_1$ (initial acceleration of the infeed rollers) as well as during deceleration between $t_2$ and $t_3$ the curve shapes, determined in accordance with FIG. 2 and dashed in FIG. 4, would lead to too great an acceleration value and/or deceleration value on the reel 3. In this case, maximum values for acceleration and deceleration of the reel 3 are preset for the determination of the rotation speed-time profile, i.e., as maximum acceleration value $be_{max}$ and as maximum deceleration value $br_{max}$, which may not be exceeded for the determination of the rotation speed-time profile. The rotation speed-time profile for the drive of the reel 3, compiled under these assumptions, is shown in FIG. 4 not as the dashed but the dotdashed line.

As shown in FIG. 4, due to the limitation to $be_{max}$, the dotdashed curve rises less steeply in the initial acceleration zone than the dashed curve but is continued for a time interval $dt_1$ beyond the moment $t_1$ to a moment $t_1'$ and therefore ends at a higher end rotation speed. The prolongation of the acceleration phase of the dotdashed curve with regard to the dashed and solid curves is chosen in such a way that the amount of wire released by the reel 3 during said acceleration phase is overall as great as the amount of wire which would be released by the dashed curve, according to FIG. 2, until the moment $t_1$.

The same applies for the case of deceleration between $t_2$ and $t_3$. Once again, the time interval between $t_2$ (beginning of the deceleration) and $t_3$ (end of the deceleration) is extended by a length $dt_2$ in order to take into account the smaller, allowable, maximum deceleration $br_{max}$. While the extension of the acceleration phase in the acceleration zone is added by $dt_1$ to the end of the acceleration phase, i.e., the acceleration starts at the same moment as the acceleration for the solid and the dashed curve, the extension of the deceleration phase $dt_2$, in the case of deceleration, is series-connected before the start of the deceleration (moment $t_2$) in the velocity-time profile, as can be clearly seen in FIG. 4.

Due to the end rotation speed at the moment $t_1'$, increased with regard to the dashed curve in FIG. 2, which is then maintained until the moment $t_2'$, an additional wire length is supplied from the reel 3 (compared to the case of the dashed curve in FIG. 2), which largely compensates for the amount of wire supply, which would have otherwise been released in the dashed curve within the time intervals $dt_1$ as well as $dt_2$, so that the amount of wire released by the reel 3 continues to be about equal to the amount of wire received by the infeed 4 throughout the entire time interval $a+t_a$.

For practical applications, the solid curve in FIG. 4 (velocity-time profile of the infeed 4) and the dotdashed curve (rotation speed-time profile of the reel 3) are combined temporally offset to each other, as shown in FIG. 3, whereby here the dashed curve from FIG. 3 is to be replaced with the dotdashed curve from FIG. 4.

Figure 5:
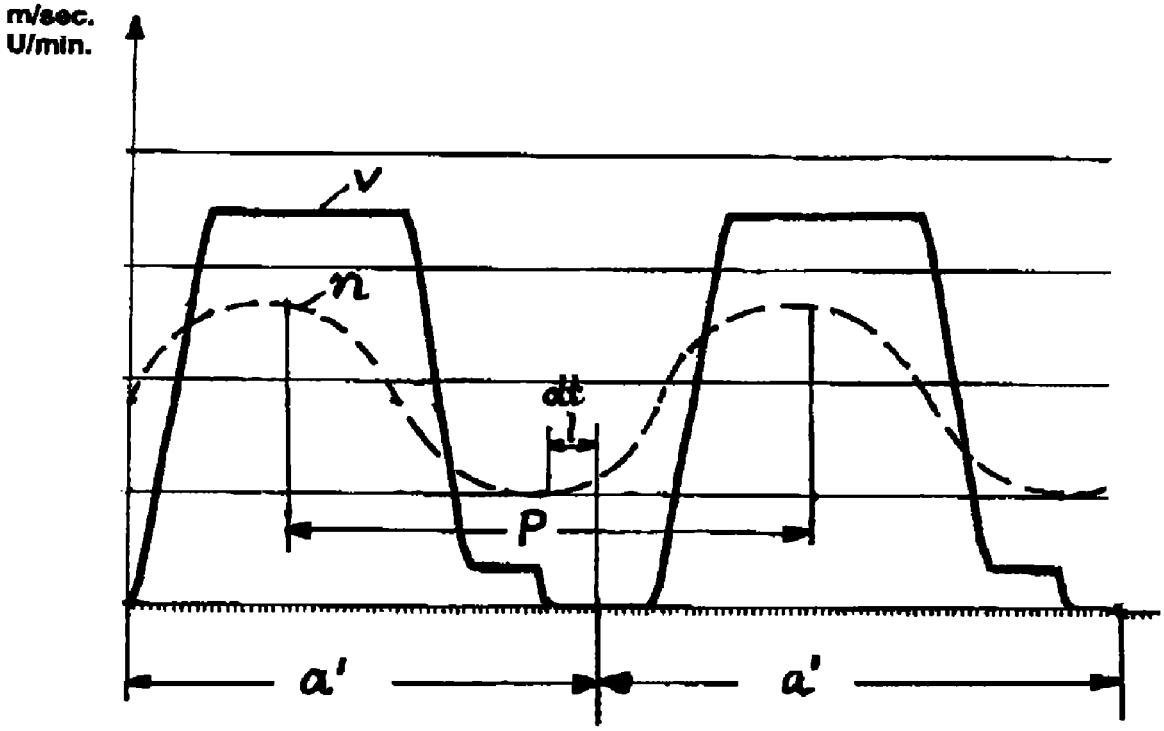
FIG. 5 shows the depiction of the graphs of a velocity-time profile for the infeed speed of the roller infeed of the wire bending machine, corresponding to the profile in FIG. 3, as well as the rotation speed-time profile of the reel in the form of a periodically changing curve also temporally set forward with regard to the velocity-time profile of the roller infeed.

FIG. 5 shows, corresponding in principle with the depiction in FIG. 3, the velocity-time profile of the infeed 4 and the rotation speed-time profile of the reel 3, whereby the latter exhibits an altered graph shape when compared to the graphs of the rotation speed-time profile in FIGS. 2 to 4. The once again dashed graph of the rotation speed-time profile of the reel 3 in FIG. 5 is provided particularly for cases during which a great number of workpieces are to be continuously manufactured successively, although only two periods for the successive manufacture of two such workpieces is shown in FIG. 5.

The rotation speed-time profile of the reel 3 is shown herein in the form of a periodically changing profile shape, which, within the time interval a' of the processing duration of a workpiece, supplies the same amount of wire length as the initially (i.e., in FIG. 2) derived rotation speed-time profile in the time interval a and the graph of which thereby runs through a complete vibration period P (or an integer multiple of such a period). However, this means in other words that the dashed rotation speed-time profile of the reel 3 in FIG. 5 is determined in the form of a periodic curve which is chosen in such a way that the wire length supplied by the reel 3 within a vibration period P is equal to the wire length which is pulled in by the infeed 4 within the processing time a' (for one workpiece). At the same time, the specifications for the maximum allowable acceleration and the maximum allowable deceleration are taken into account for the determination of this rotation speed-time profile, same as the temporal advance dt of the rotation speed-time profile, shown in FIG. 3, with regard to the velocity-time profile of the infeed 4. The control of such a rotation speed course on the reel 3, shown as the dashed line in FIG. 5, is simply and easily implemented also for a quick periodicity, which is particularly advantageous for the continuous manufacture of a great number of the same workpiece.

The invention claimed is:

1. A device for providing wire and controlling the drive of a reel, comprising:

a wire supply in the form of a coil on the reel, from which the wire, through interposition of a tensioning device, is spring-pretensioned in one deflection direction and effective up to a maximum deflection for approximated stabilization of a wire tension to a wire infeed device for a downstream positioned wire processing machine;

whereby a velocity curve of an infeed rate of the wire infeed device in accordance with a preset velocity-time profile is controlled by a control unit of the wire processing machine, and whereby a rotation speed of the reel in accordance with a preset rotation speed-time profile is controlled by a drive control of the reel, whereby the drive control of the reel starts the rotation in accord with the rotation speed-time profile of the reel set forward by a preset time interval with respect to the velocity-time profile of the infeed rate.

2. The device of claim 1, wherein the rotation speed-time profile of the reel is compiled from the velocity-time profile of the infeed rate, whereby a respective rotation speed of the reel is determined for every infeed rate of the velocity-time profile, and whereby a wire release speed of the reel equals the infeed rate of the wire infeed.

3. The device of claim 1, wherein the preset time interval is determined in such a way that a wire release length, supplied along its curve in accordance with the rotation speed-time profile of the reel, is smaller than a wire length which the tensioning device can compensate at the maximum deflection.

4. The device of claim 1, wherein preset values for a maximum acceleration and for a maximum deceleration of the reel are taken into account for the determination of the rotation speed-time profile of the reel, whereby in the case of acceleration and deceleration values in an acceleration phase and deceleration phase in the velocity-time profile which would lead to greater than the preset values for maximum acceleration and deceleration, respectively, at the rotation speed-time profile of the reel, the acceleration and deceleration values are replaced through the utilization of preset values for maximum acceleration and deceleration and the acceleration phase and deceleration phase are each temporally extended in such a way that the wire infeed length of the wire infeed corresponding to the acceleration or deceleration phase, correspond to the wire release length of the reel, released during the same time interval, whereby the beginning of an acceleration phase extended in such a way as well as the end of a deceleration phase extended in such a way remain unchanged when compared to the beginning and/or end of the corresponding acceleration or deceleration phase of the velocity-time profile of the infeed rate.

5. The device of claim 1, wherein the determination of the rotation speed-time profile of the reel from the velocity-time profile of the infeed rate is effected by the control unit of the wire processing machine and is transmitted from said machine to the drive control of the reel.

6. The device of claim 1, wherein unsteady velocity changes present in the velocity-time profile of the infeed rate are represented through steady profile transitions during the determination of the rotation speed-time profile for the reel.

7. The device of claim 1, wherein the rotation speed-time profile of the reel derived from the velocity-time profile of the infeed rate for the duration of the processing of one workpiece each during continuous manufacture of the same workpieces in the wire processing machine is replaced by a periodically changing rotation speed-time profile, which within the time interval of the processing duration of a workpiece supplies the same wire release length as the initially derived rotation speed-time profile and the graph of which thereby runs through an entire vibration period or an integer multiple of such a period.

8. The device of claim 1, wherein the control of the reel drive effects a continuous increase of the reel rotation speed compensating for a decrease of a diameter of the coil at an otherwise constant rotation speed-time profile curve.

9. A device for providing wire and for controlling the drive of a reel, the device comprising:

a reel containing a supply of wire in the form of a coil;

a wire infeed device downstream of the reel adapted to receive the wire from the reel and provide it to a wire processing machine;

a tensioning device interposed along the wire extending from the reel to the wire infeed device to spring-pretension the wire for stabilization of a wire tension of the wire; and wherein a velocity curve of a infeed rate of the wire to the wire infeed device in accordance with a preset velocity-time profile is controlled by a control unit of the wire processing machine, and wherein a rotation speed curve of the reel in accordance with a preset rotation speed-time profile is controlled by a drive control of the reel, and wherein the drive control of the reel starts the rotation of the reel in accord with the speed-time profile and set forward by a preset time interval with regard to the velocity-time profile of the feed rate.

10. The device of claim 9, wherein the rotation speed-time profile of the reel is compiled from the velocity-time profile of the feed rate and a respective rotation speed of the reel is determined for every feed rate of the velocity-time profile and wherein a wire release speed of the reel equals the feed rate of the wire infeed.

11. The device of claim 9, wherein the preset time interval is determined such that a wire release length supplied in accordance with the rotation speed-time profile of the reel is smaller than a wire length for which the tensioning device can compensate at the maximum deflection.

12. The device of claim 9, wherein the drive control of the reel includes preset values for a maximum acceleration and a maximum deceleration of the reel which are taken into account in determining the rotation speed-time profile of the reel and, if an acceleration phase and deceleration phase in the velocity-time profile would lead to acceleration and deceleration values that are greater than the preset values, the acceleration and deceleration values are replaced with the preset values and the acceleration and deceleration phases are each temporally extended such that a wire infeed length of the wire infeed during the acceleration phase and the deceleration phase correspond to a wire release length of the reel released during the same time interval, and wherein the beginning of the temporally extended acceleration phase and the end of the temporally extended deceleration phase remain the same as the acceleration and deceleration phases in the velocity-time profile.

13. The device of claim 9, wherein the control unit determines the rotation speed-time profile of the reel from the velocity-time profile of the feed rate and transmits the rotation speed-time profile to the drive control of the reel.

14. The device of claim 9, wherein unsteady velocity changes present in the velocity-time profile of the feed rate are represented through steady profile transitions during the determination of the rotation speed-time profile for the reel.

15. The device of claim 9, wherein the rotation speed-time profile of the reel for the duration of processing of one workpiece during the continuous manufacture of a plurality of workpieces in the wire processing machine is replaced by a periodically changing rotation speed-time profile within which a time interval of a processing duration of the workpiece supplies a same wire release length as the rotation speed-time profile and a graph of the rotation-speed time profile runs through an entire vibration period or an integer multiple of said period.

16. The device of claim 9, wherein the control of the reel drive effects a continuous increase of a speed of rotation of the reel to compensate as a diameter of the coil decreases at an otherwise constant rotation speed-time profile.

17. A method of providing wire, the method comprising:

providing wire to a wire feed device for a wire processing machine from a wire supply in the form of a coil on a reel, controlling the speed of rotation of the reel in accordance with a preset rotation speed-time profile, and causing the wire from the reel to be received at a wire infeed downstream of the reel at a feed rate in accordance with a preset velocity-time profile, wherein the preset rotation speed-time profile corresponds to the preset velocity-time profile.

18. The method of claim 17, further comprising the step of pretensioning the wire from the reel.

19. The method of claim 18, rotating the reel in accord to the rotation speed-time profile of the reel set forward by a preset time interval with regard to the feeding of the wire with regard to the velocity-time profile of the feed rate.

* * * * *